US008132378B2

(12) United States Patent
Rizzon

(10) Patent No.: US 8,132,378 B2
(45) Date of Patent: Mar. 13, 2012

(54) GLASS ELEMENT FOR FORMING GLASS BRICK WALLS, AND PROCESS FOR FORMING WALLS WITH SAID ELEMENT

(76) Inventor: Nadia Rizzon, Feltre (IT)

( * ) Notice: Subject to any disclaimer, the term of this patent is extended or adjusted under 35 U.S.C. 154(b) by 58 days.

(21) Appl. No.: 12/812,495

(22) PCT Filed: Jan. 16, 2009

(86) PCT No.: PCT/EP2009/050518

§ 371 (c)(1),
(2), (4) Date: Jul. 12, 2010

(87) PCT Pub. No.: WO2009/092675

PCT Pub. Date: Jul. 30, 2009

(65) Prior Publication Data

US 2010/0287866 A1 Nov. 18, 2010

(30) Foreign Application Priority Data

Jan. 21, 2008 (IT) ..... VE2008A0002

(51) Int. Cl.
*E04C 1/42* (2006.01)

(52) U.S. Cl. ..... 52/308; 52/306; 52/745.1

(58) Field of Classification Search ..... 52/306–308, 52/745.1

See application file for complete search history.

(56) References Cited

U.S. PATENT DOCUMENTS

| | | | | | |
|---|---|---|---|---|---|
| 2,156,623 | A | * | 5/1939 | Eastus | 52/308 |
| 2,167,764 | A | * | 8/1939 | Lytle | 52/307 |
| 3,286,423 | A | * | 11/1966 | Donlon | 52/287.1 |
| 4,648,226 | A | * | 3/1987 | Manon | 52/308 |
| 4,793,104 | A | * | 12/1988 | Hultberg et al. | 52/127.3 |
| 4,891,925 | A | * | 1/1990 | Carlson et al. | 52/585.1 |
| 5,261,205 | A | * | 11/1993 | Sandor | 52/591.4 |
| 5,367,846 | A | * | 11/1994 | vonRoenn, Jr. | 52/308 |
| 5,588,271 | A | * | 12/1996 | Pitchford | 52/306 |
| 5,778,620 | A | * | 7/1998 | Fisher | 52/306 |
| 5,806,263 | A | * | 9/1998 | Coleman | 52/306 |
| 5,904,019 | A | * | 5/1999 | Kooij et al. | 52/306 |
| 5,970,673 | A | * | 10/1999 | Fisher | 52/306 |
| 5,987,829 | A | * | 11/1999 | Fisher | 52/306 |
| 2007/0277461 | A1 | * | 12/2007 | Regina | 52/306 |

FOREIGN PATENT DOCUMENTS

| | | | |
|---|---|---|---|
| DE | 1956439 | U | 3/1967 |
| DE | 3214724 | A | 11/1983 |
| EP | 0166219 | A | 1/1986 |

OTHER PUBLICATIONS

PCT/EPO, International Preliminary Report on Patentability, May 3, 2010.

* cited by examiner

*Primary Examiner* — Robert Canfield
(74) *Attorney, Agent, or Firm* — Themis Law

(57) ABSTRACT

A glass element for forming glass brick walls, which has an overall parallelepiped shape and side walls shaped to enable insertion-engagement with the adjacent elements.

4 Claims, 2 Drawing Sheets

GLASS ELEMENT FOR FORMING GLASS BRICK WALLS, AND PROCESS FOR FORMING WALLS WITH SAID ELEMENT

FIELD OF THE INVENTION

The present invention relates to a glass element for forming glass brick walls, and a process for forming walls with said element.

BACKGROUND OF THE INVENTION

Glass brick walls are known, i.e. walls made with hollow glass blocks, commonly called glass bricks, joined together by cement mortar to provide stability thereto.

Known glass bricks are of parallelepiped shape with two square or rectangular faces which, when the element is installed, form the inner and outer exposed surfaces, and a perimetral band of lesser width which joins the two exposed faces together and remains slightly inwards of their edge to define, when laid, horizontal and vertical channels for containing the cement mortar which securely joins the bricks together.

To form the wall, the end glass brick of the lower row is firstly laid on an underlying mortar bed, after which the glass bricks of the lower row are placed one after the other against the preceding, after interposing therebetween some mortar and a spacer provided at its ends with centering elements. After completing the first row the next row is laid, and so on, until the entire wall is formed. On termination, after the mortar has set, the centering elements of the spacers are removed, the gaps are filled and the formed wall is cleaned.

This method, which is virtually the most widespread, is substantially imposed by the shape of current glass bricks, which has brought to light a series of drawbacks.

One of these drawbacks is that during application of the cement mortar between one glass brick and the next, the cement mortar can escape through the gaps between them; this suggests that only the strictly necessary mortar quantity, or even less, should be used, even though this expedient has not proved satisfactory in practice and a certain quantity of mortar still has to be removed from the formed wall.

Another drawback is that, as mortar can often deposit between the spacers and the relative centering elements, removable only after the mortar has set, such removal can result in a time loss for its removal and a difficult surface-finishing of the wall.

Another drawback is that the slow mortar setting rate, due to lack of water absorption by the glass, means that the laying of the glass bricks has to be periodically suspended to enable the mortar to set, otherwise the wall could deform.

Another drawback is that the need to fill the gaps between the glass bricks results in lengthy and laborious operations.

SUMMARY OF THE INVENTION

All these drawbacks are eliminated by a glass element for forming glass brick walls according to the invention.

Again according to the invention, a glass element includes two glass concave half-shells that are joined together along the edges of side concave portions and has an overall parallelepiped shape with two exposed faces and with side walls shaped to enable an insertion-engagement with the adjacent elements. Along two adjacent sides of each exposed face there is provided an outer first step and respectively an inner second step projecting less than said outer first step, while along the other two adjacent sides of the same exposed face there is provided an outer third step and respectively an inner fourth step projecting more than said outer third step, each more projecting outer first step having an extension that is less than that of each more projecting inner fourth step.

BRIEF DESCRIPTION OF THE DRAWINGS

A preferred embodiment of the present invention is described in detail hereinafter with reference to the accompanying drawings, in which.

DETAILED DESCRIPTION OF EMBODIMENTS OF THE INVENTION

Figure 1:
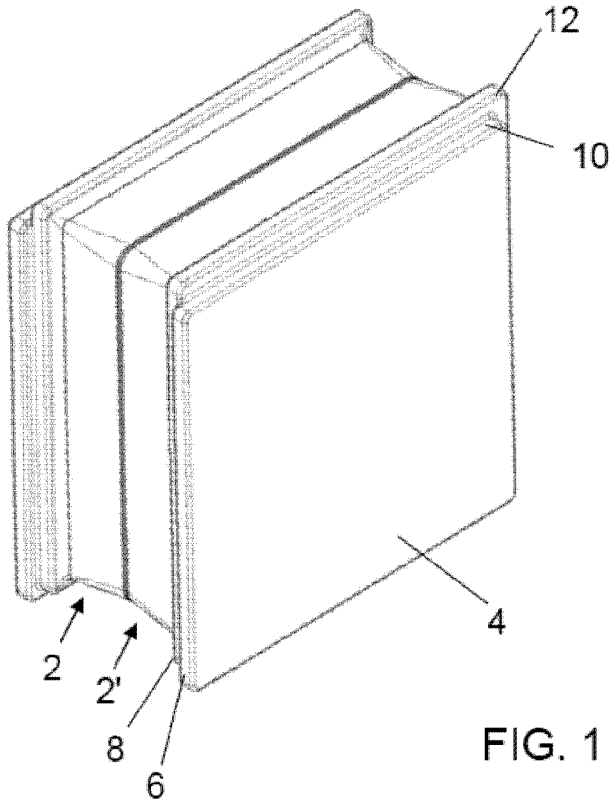
FIG. 1 is a perspective view of a glass brick according to the invention.
Figure 2:
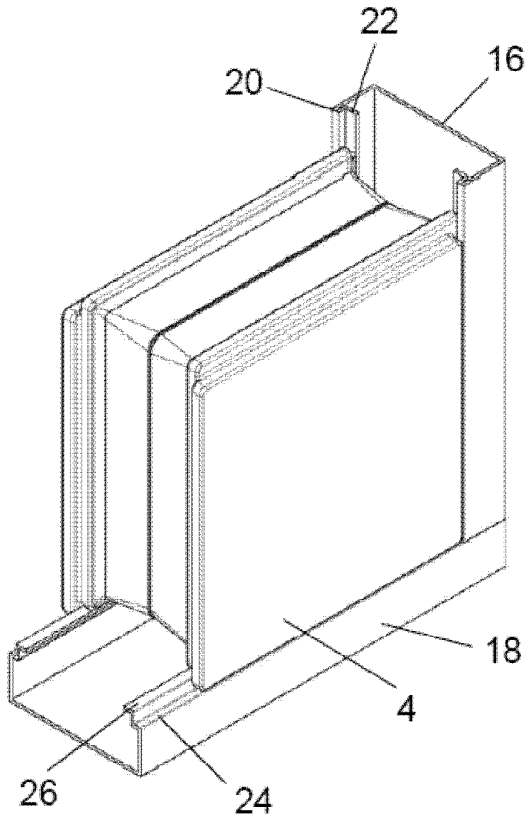
FIG. 2 shows the glass brick of FIG. 1 coupled to two perpendicular profile portions to define a glass brick wall.
Figure 3:
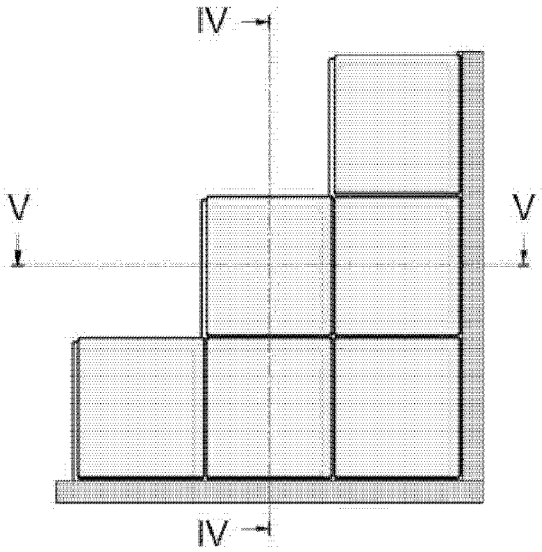
FIG. 3 is a front view of a portion of a glass brick wall.
Figure 4:
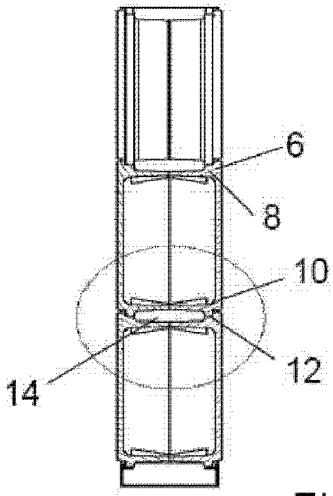
FIG. 4 is a vertical section along line IV-IV of FIG. 3.
Figure 5:
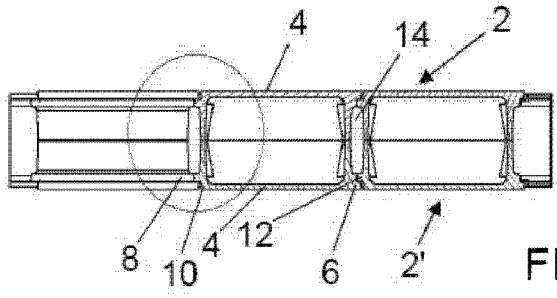
FIG. 5 is a horizontal section along line V-V of FIG. 3.

As it can be seen from the figures, the glass element (glass brick) of the invention comprises two concave glass half-shells 2, 2', which are joined together along the edges of the concave portions to form a hollow glass brick of dimensions similar to those of traditional glass bricks. However in contrast to traditional glass bricks, on its four sides forming the perimetral band, the glass element of the invention presents in proximity to each exposed face 4 a pair of steps which facilitate stable insertion-fitting of adjacent elements.

More specifically, along two adjacent sides of each exposed face 4, there is provided an outer first step 6 which projects more than an inner second step 8, while along the other two adjacent sides of the same exposed face 4 there is provided an outer third step 10 projecting less than an inner fourth step 12. In addition, each more projecting outer step 6 has a height less than the more projecting inner fourth step 12.

This greater height of the inner steps 12 compared with the outer steps 6 means that when the various glass elements are coupled together to form the glass brick wall, the adjacent elements are in contact only along the inner steps 8 and 12, whereas their outer steps 6 and 10, which in practice have their face coplanar with the exposed face 4, remain slightly spaced apart to form the gaps between the glass bricks and guide elements for their correct fitting-together. The gaps formed in this manner have their base closed by the outer side face of the more projecting inner steps 12.

In addition, the said mutually contacting inner steps 8 and 12 define, with the lateral faces of the half-shells 2, 2', laterally closed longitudinal channels 14 which intersect the perpendicular longitudinal channels to form an outwardly closed lattice to receive the cement mortar.

The said insertion-fitting system between adjacent glass elements also exists between these and the profiles 16, 18 perimetrally defining the glass brick wall.

More specifically, there are provided female profiles 16 with their outer step 20 projecting more than their inner step 22, and male profiles 18 with their outer step 24 projecting less than their inner step 26, the more projecting inner step 26 of the male profile 18 having a greater height than the more projecting outer step 20 of the female profile 16, as in the case of the glass elements.

To form the glass brick wall, after arranging a horizontal male profile 18 and, at the ends thereof, two vertical profiles, namely a male 18 and a female 16, the laying of the individual elements begins. By virtue of the insertion fitting system virtually an entire wall can be formed, or at least part of it, particularly in the case of large dimensions, without any loss of stability, even without using cement mortar.

When the wall has been formed, the cement mortar is inserted into the channels 14. As all these channels communicate with each other, correct and complete filling is assured, without the mortar being able to escape to the outside.

The upper female closure profile 16 is then applied and the mortar then allowed to harden.

The glass element of the invention for forming glass brick walls is evidently much more advantageous than traditional elements, and in particular:

it eliminates the need to use spacers and centering elements, while ensuring high positioning regularity between adjacent elements, it eliminates the need to fill gaps and to finish the wall when formed, it enables the bricks to be laid even by non-specialized personnel, it enables a very high laying rate to be attained while at the same time obtaining a perfect appearance, and also it enables the mortar to completely fill the channels between adjacent elements without any wastage, with the assurance of optimal final stability.

What is claimed is:

1. A glass element for forming a glass brick wall comprising:

two glass concave half-shells joined together along edges of the concave half-shells and forming an overall parallelepiped shape with two exposed faces and with side walls shaped to enable an insertion-engagement with adjacent elements, wherein along two adjacent sides of each exposed face there is provided an outer first step and respectively an inner second step projecting less than said outer first step, while along two other adjacent sides of the same exposed face there is provided an outer third step and respectively an inner fourth step projecting more than said outer third step, each more projecting outer first step having a height less than each more projecting inner fourth step.

2. The element as claimed in claim 1, wherein the inner second and fourth steps on each side of said element define, with the respective side walls, longitudinal channels which together with the longitudinal channels of adjacent elements of the glass brick wall form a lattice of mutually communicating channels configured to receive cement mortar to stabilize the various elements.

3. A process for forming a glass brick wall using glass elements in accordance with comprising:

at least partially dry-forming a wall by insertion-fitting elements according to claim 1 together one adjacent to another in a horizontal direction and in a vertical direction;

pouring cement mortar into vertical and horizontal closed channels defined by the dry-forming; and allowing the cement mortar to harden to mutually stabilize the elements.

4. The process as claimed in claim 3, further comprising the steps of:

bounding the wall with essentially U-shaped profiles having lateral flanges defining steps complementary to the steps present in the glass elements; and forming, with the side walls of the glass elements, additional channels configured to receive the cement mortar.

* * * * *